US009676112B2

(12) United States Patent
Bolcar

(10) Patent No.: US 9,676,112 B2
(45) Date of Patent: Jun. 13, 2017

(54) EXTENDER AND METHOD FOR HOLDING A RAZOR

(71) Applicant: Charles Bolcar, Hewitt, NJ (US)

(72) Inventor: Charles Bolcar, Hewitt, NJ (US)

( * ) Notice: Subject to any disclaimer, the term of this patent is extended or adjusted under 35 U.S.C. 154(b) by 196 days.

(21) Appl. No.: 14/177,311

(22) Filed: Feb. 11, 2014

(65) Prior Publication Data

US 2015/0224657 A1 Aug. 13, 2015

(51) Int. Cl.

| | |
|---|---|
| ***B26B 21/52*** | (2006.01) |
| ***B25G 1/02*** | (2006.01) |
| ***B25G 3/24*** | (2006.01) |
| ***B25G 1/10*** | (2006.01) |

(52) U.S. Cl.

CPC ..... *B26B 21/523* (2013.01); *B25G 1/102* (2013.01); *B25G 3/24* (2013.01); *Y10T 29/49716* (2015.01)

(58) Field of Classification Search

CPC ..... B26B 21/523; B25G 1/102; B25G 3/24
USPC ..... 30/526; 16/427, 429, 430
See application file for complete search history.

(56) References Cited

U.S. PATENT DOCUMENTS

| | | | | | |
|---|---|---|---|---|---|
| 4,905,372 | A | | 3/1990 | Willis | |
| 5,070,576 | A | * | 12/1991 | Banta | A01G 3/053 16/427 |
| D353,751 | S | * | 12/1994 | Germano | D8/8 |
| 5,421,060 | A | * | 6/1995 | Miller | A01G 3/053 16/427 |
| D375,408 | S | | 11/1996 | Muller | |
| 5,860,216 | A | * | 1/1999 | Shellnutt | B23D 51/10 30/166.3 |
| 5,926,913 | A | * | 7/1999 | Hernandez | B25B 13/481 16/114.1 |
| 5,979,080 | A | * | 11/1999 | Borsoi | A43C 1/00 24/712 |
| D431,681 | S | | 10/2000 | Seger | |
| 6,189,222 | B1 | | 2/2001 | Doyle | |
| 6,237,194 | B1 | * | 5/2001 | Williams | A47G 21/08 15/443 |
| 6,505,403 | B1 | * | 1/2003 | Andrews | B26B 21/00 30/29.5 |
| D472,673 | S | | 4/2003 | Carvotta et al. | |
| D507,379 | S | | 7/2005 | Alphonso | |
| D560,032 | S | | 1/2008 | Lopez et al. | |
| D611,655 | S | | 3/2010 | Askew | |
| D623,800 | S | | 9/2010 | Clemons | |
| 7,856,725 | B2 | | 12/2010 | Marut | |
| 8,006,393 | B2 | | 8/2011 | Collins | |
| D656,675 | S | | 3/2012 | Payne | |
| 9,138,043 | B1 | * | 9/2015 | Meier | A45F 5/10 |
| 2003/0177648 | A1 | | 9/2003 | Zeiter | |
| 2003/0204958 | A1 | | 11/2003 | Jewell | |
| 2004/0107585 | A1 | | 6/2004 | Helmrich | |
| 2007/0227015 | A1 | | 10/2007 | Collins | |

(Continued)

FOREIGN PATENT DOCUMENTS

| | | | | | |
|---|---|---|---|---|---|
| DE | 202014008300 | U1 | * | 11/2014 | B26B 21/523 |
| FR | 609618 | A | * | 8/1926 | B26B 21/40 |
| GB | 2476096 | B | * | 1/2014 | A45D 26/0028 |

*Primary Examiner* — Laura M Lee
(74) *Attorney, Agent, or Firm* — Thomas L. Adams

(57) ABSTRACT

An extender has a cradle at the distal end of an extension arm. The handle of a razor is placed in the cradle and held in place by a lash that connects across the spaced edges of the cradle. The length of the cradle avoids rocking of the razor handle about an axis transverse to the longitudinal axis of the cradle.

20 Claims, 9 Drawing Sheets

(56) References Cited

U.S. PATENT DOCUMENTS

| | | | | |
|---|---|---|---|---|
| 2011/0088268 | A1 | 4/2011 | Marut | |
| 2011/0094114 | A1 | 4/2011 | Payne-Baggetta | |
| 2013/0298412 | A1* | 11/2013 | Harski | B26B 21/523 30/526 |
| 2015/0013174 | A1* | 1/2015 | Hanamura | B26B 21/523 30/526 |

* cited by examiner

EXTENDER AND METHOD FOR HOLDING A RAZOR

BACKGROUND OF THE INVENTION

1. Field of the Invention

The present invention relates to apparatus and methods for holding a razor, and in particular, to extenders for holding a razor at a remote position 2. Description of Related Art People often wish to shave areas of their body that are not easily accessible. For example, men may wish to shave hair on their back but are usually unable to reach back far enough to apply a shaving razor (disposable or otherwise) against some of the areas requiring shaving. Also, women may wish to shave their legs but find that bending down in a shower or elsewhere places them off balance and increases the risk of falling. In some cases the elderly or people with physical impairments may have limited flexibility and may be unable to reach areas that they wish to shave.

Any scheme for extending the reach of a shaving razor ought to be able to accommodate a variety of conventional shaving razors that can have extremely different shaving handles. Some shaving handles may be straight and thin. Other shaving handles may be relatively thick, curved, or made with protrusions offering a better ergonomic grip. Also, any practical scheme for extending the reach of a shaving razor ought to use apparatus and methods that prevent the shaving razor from shifting or rocking in a way that impairs the ability to shave accurately and safely.

See the following U.S. Design Patents: D375408; 4,905,372; D431681; D472673; D507379; D560032; D611655; D623800; D656675. See also U.S. Pat. Nos. 6,189,622; 7,856,725; and 8,006,393, as well as U.S. Patent Application Publication Nos. 2003/0177648; 2003/0204958; 2004/0107585; 2007/0227015; 2011/0088268; and 20110094114.

SUMMARY OF THE INVENTION

In accordance with the illustrative embodiments demonstrating features and advantages of the present invention, there is provided an extender for holding a shaving razor by its razor handle. The extender has a cradle and an extension arm. The extension arm has a proximal and a distal end. The cradle is coupled to the distal end of the extension arm and is sized to receive the razor handle. The cradle has a longitudinal axis and a spaced pair of longitudinally extending edges. The extender also has a lash adapted to be connected across the spaced pair of edges of the cradle for holding the razor handle in the cradle. The cradle has a cradle length sized to avoid rocking of the razor handle about an axis transverse to the longitudinal axis of the cradle.

In accordance with another aspect of the invention, an extender is provided for holding a shaving razor by its razor handle. The extender has an extension arm with a proximal and a distal end. Also included is a cradle coupled to the distal end of the extension arm and sized to receive the razor handle. The cradle has a longitudinal axis and a spaced pair of longitudinally extending edges. The cradle has a cradle length sized to avoid rocking of the razor handle about an axis transverse to the longitudinal axis of the cradle.

In accordance with yet another aspect of the invention, a method is provided for holding a shaving razor. The method employs a cradle on an extension arm and a lash. The method includes the step of placing the razor handle in the cradle. Another step is using the lash to secure the razor handle in the cradle to avoid rocking of the razor handle about an axis transverse to the longitudinal axis of the cradle.

By employing apparatus and methods of the foregoing type an improved scheme is achieved for allowing a person to shave skin areas that are not easily accessible. In a disclosed embodiment a cradle mounted on the end of an extension arm can hold a shaving handle. The cradle has on its outside edges curled lips that are notched. An elastomeric ring is draped over the shaving handle and snapped under the curled lips. For relatively large shaving handles the elastomeric ring will be routed only under a portion of the curled lip, and will emerge prematurely through a selected one of the notches in the lip. Thus, by selecting an appropriate routing path one can change the capacity of the cradle and elastomeric ring to hold a large variety of handles of different sizes and shapes.

In this embodiment, a corner of one of the lips is beveled so that the elastomeric ring can be easily removed.

Another embodiment is disclosed where the cradle has on each side a number of ledges that are stacked in a tier. This embodiment has four ledges, two on each side. The ledges have a concave underside for holding a portion of an elastomeric ring. Also, the ledges have different lengths, so that the capacity of the ring can be changed by using ledges that are longer or shorter, or are nearer or farther.

In yet another embodiment, the cradle will have neither ledges nor lips and instead a pair of elastomeric rings will be snapped around the shaving handle and around the cradle. In some cases a semicylindrical cowl can be placed over the shaving handle so that the elastomeric rings squeeze the cowl and cradle together to grip the shaving handle.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
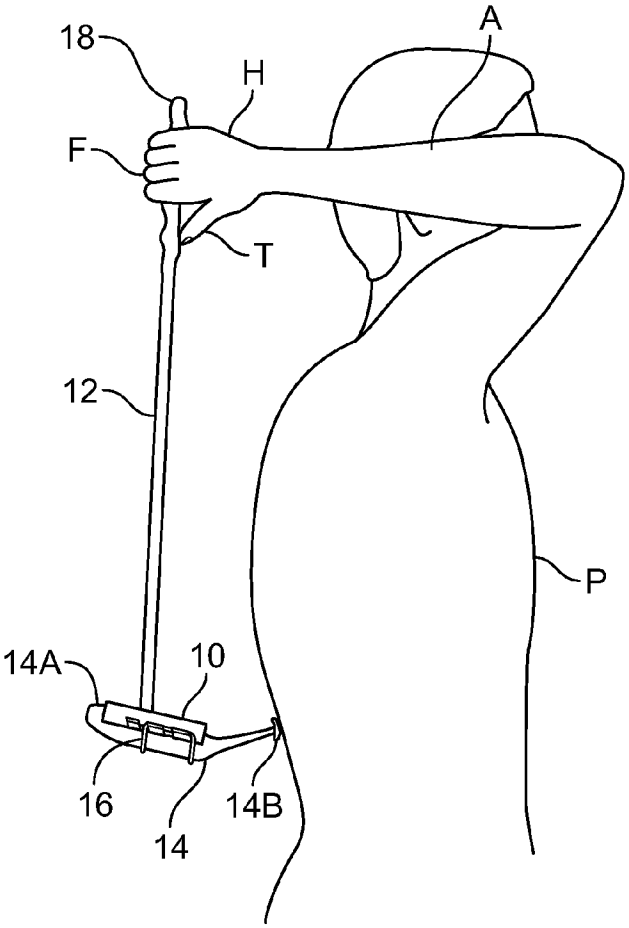
FIG. 1 is a side view of an extender being used to hold a razor in accordance with principles of the present invention.
Figure 3:
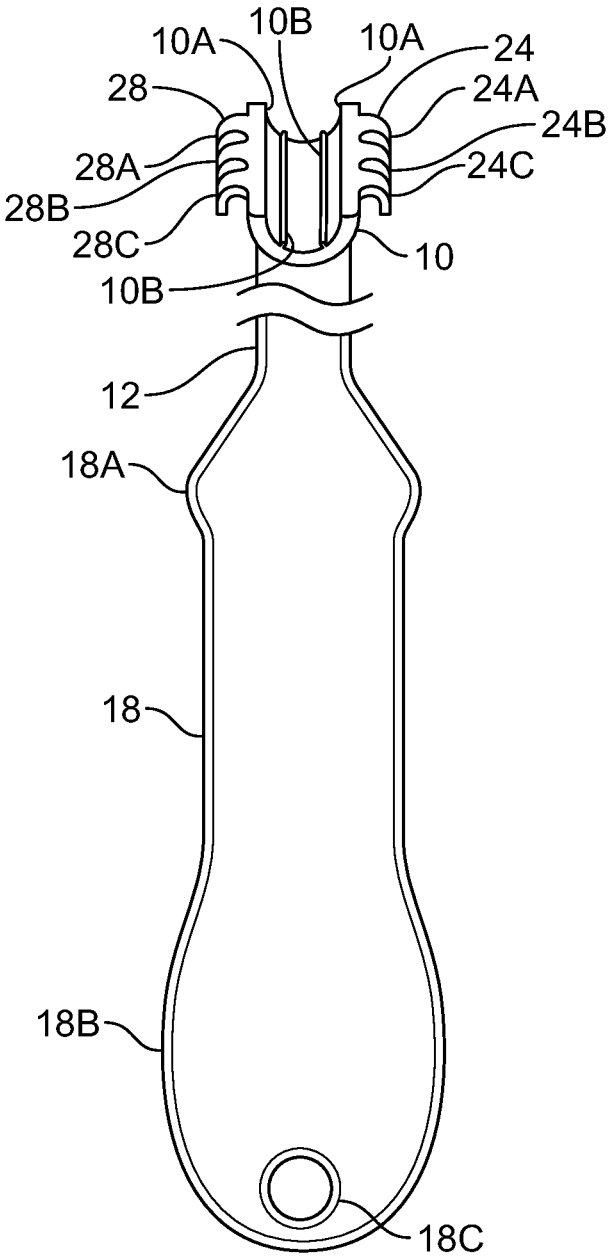
FIG. 3 is an elevational view of the back of the extender of FIG. 1.

Referring to FIG. 1 an extender is shown having cradle 10 attached obliquely to the distal end of extension arm 12. Razor handle 14A of shaving razor 14 is shown secured in cradle 10 by lash 16. In this embodiment, lash 16 is an elastomeric loop that is described in further detail hereinafter.

Referring to FIGS. 2-5, the proximal end of extension arm 12 has a grip 18. This grip 18 has a narrow section between a distal flare 18A, and an enlarged proximal butt 18B that is pierced with hang hole 18C. Grip 18 is somewhat flattened, but has on its back face, undulations 18D that provide a number of finger channels. Grip 18 also has on the front of butt 18B, a hump 18E that cooperates with elements 18A and 18B to center the hand on the grip.

Figure 2:
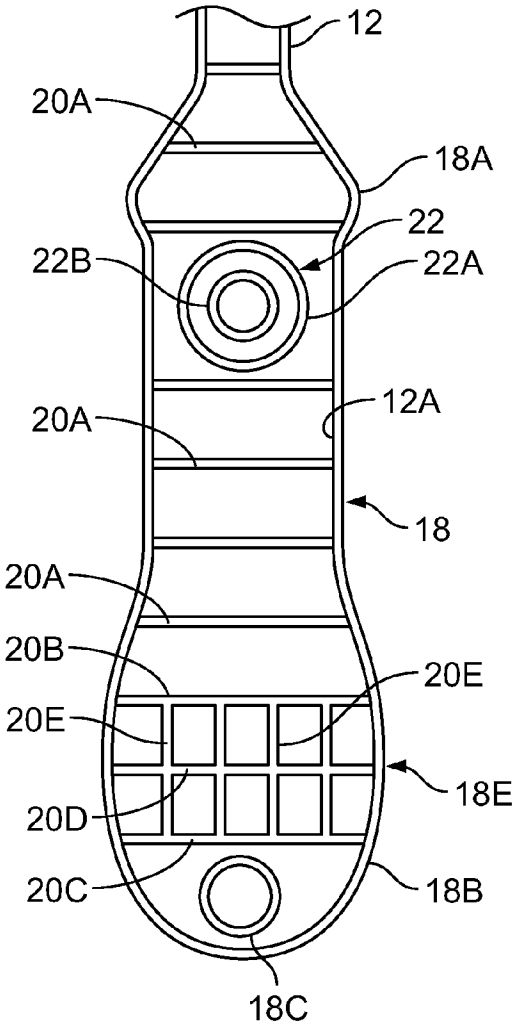
FIG. 2 is a detailed, fragmentary view of the front of the proximal end of the extender of FIG. 1.

As shown in FIG. 2, the front face of arm 12 and grip 18 is concave and bordered by peripheral wall 12A. Wall 12A is taller at hump 18E and the prominence of this hump is based on an elevated honeycomb structure composed of parallel longitudinal walls 20E and transverse, parallel walls 20B, 20C, and 20D. Grip 18 as well as the rest of extension arm 12 is reinforced by a number of parallel walls 20A extending transversely between sidewalls 12A.

In FIG. 2, hang hole 18C is shown extending into a cylindrical sleeve. FIG. 2 also shows a concentric pair of cylindrical walls 22A and 22B that can be used as a thumb rest. The longitudinal position of this thumb rest can be changed to satisfy user's tastes.

The spaced pair of longitudinally extending edges 10A of cradle 10 (FIGS. 3-5) are fitted with outwardly extending members 24 and 26, shown in this embodiment as curled lips. Lip 24 is composed of a spaced plurality of projections 24A, 24B, and 24C separated by gaps (notches) 26A and 26B. Lip 28 has a spaced plurality of projections 28A, 28B, and 28C separated by gaps (notches) 30A and 30B.

The length of cradle 10 (along longitudinal axis 100) is approximately 2.2 inches (5.6 cm), while the edge to edge spacing between edges 10A is approximately 1 inch (2.5 cm), although different sizes and dimensions can be used depending on the expected sizes of the razor handle. It is desirable to have a substantial cradle length to avoid rocking of the razor handle along an axis that is perpendicular to longitudinal axis 100. In particular, it is desirable to have the cradle length greater than the edge to edge spacing between edges 10A, and highly desirable to have the cradle length more than twice the edge to edge spacing.

Cradle axis 10C is shown at an oblique angle of 110° relative to the length of extension arm 12, although various other angles will be useful. Also, a pair of longitudinal ridges 10B are shown extending along the inside of cradle 10 and are designed to grip and prevent axial rotation of a razor handle placed inside the cradle.

Extension arm 12 and cradle 10 may be injection molded from polyethylene impregnated with glass fibers for added stiffness, although other materials can be used including non-plastic materials. In some cases the extender can be made of separate components that snap together or are assembled by gluing, heat welding, etc. In this embodiment extension arm 12 is 14.7 inches long (37.3 cm) and the overall length of the extender (elements 10 and 12) is 15.8 inches (40 cm), although these dimensions can be varied in other embodiments depending upon the desired reach of the extender.

Figure 6:
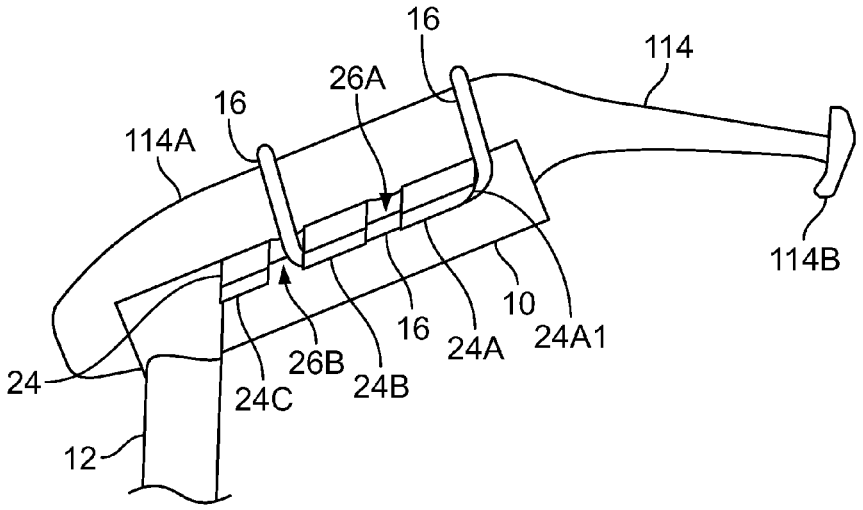
FIG. 6 is a side elevational view of the extender of FIG. 5 shown holding a shaving razor that is different from that shown in FIG. 1.

To facilitate an understanding of the principles associated with the foregoing apparatus, its operation will be briefly described. In FIG. 1 razor handle 14A is shown lying in cradle 10 with shaving head 14B extending from the distal end of the cradle. In FIG. 6 razor handle 114A is shown lying in cradle 10 with shaving head 114B extending from the distal end of the cradle. Razor handle 114A is somewhat thicker than razor handle 14A. Unless specified otherwise, the following will apply to either the embodiment of FIG. 1 or FIG. 6.

Figure 5:
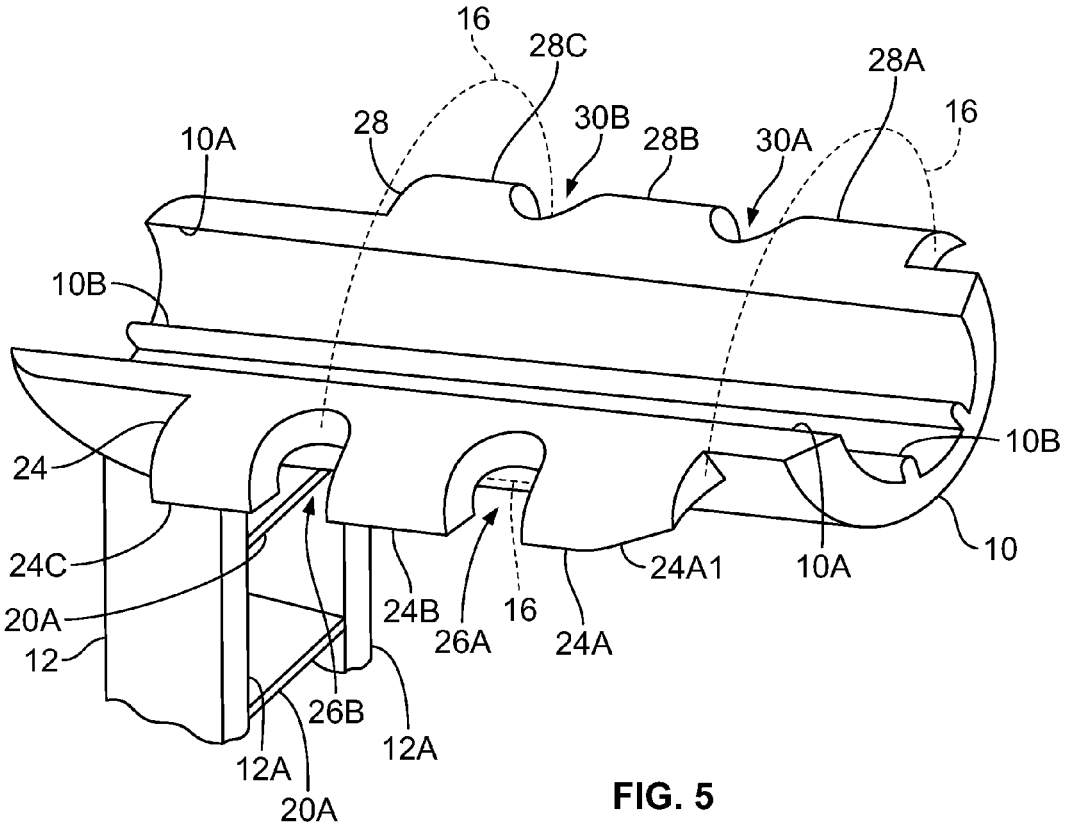
FIG. 5 is a fragmentary, perspective view of the distal end of the extender of FIG. 1.

Referring to FIGS. 5 and 6, lash 16 is an elastomeric loop routed around handle 114A and under members 24 and 28. In one embodiment lash 16 was an O-ring having approximately a 5 inch (2.7 cm) circumference and a 0.1 inch (0.25 cm) thickness. In this embodiment lash 16 is a No. 19 silicone O-ring that has only a modest ability to stretch and can therefore hold a razor handle tightly. It will be appreciated that other types of elastic rings or bands can be used instead.

In FIG. 5 the routing of lash 16 is shown as a single dotted line, while in FIG. 6 lash 16 is drawn with full double lines. Lash 16 is routed as follows: through notch 26B, under projections 24B and 24A, emerging upwardly to arch over the top of handle 114A, and then under projections 28A and 28B, before emerging through notch 30B and arching back over handle 114A to return to the point and place of beginning. It will be appreciated that razor 14 of FIG. 1 can be installed on cradle 10 in a similar fashion.

Figure 4:
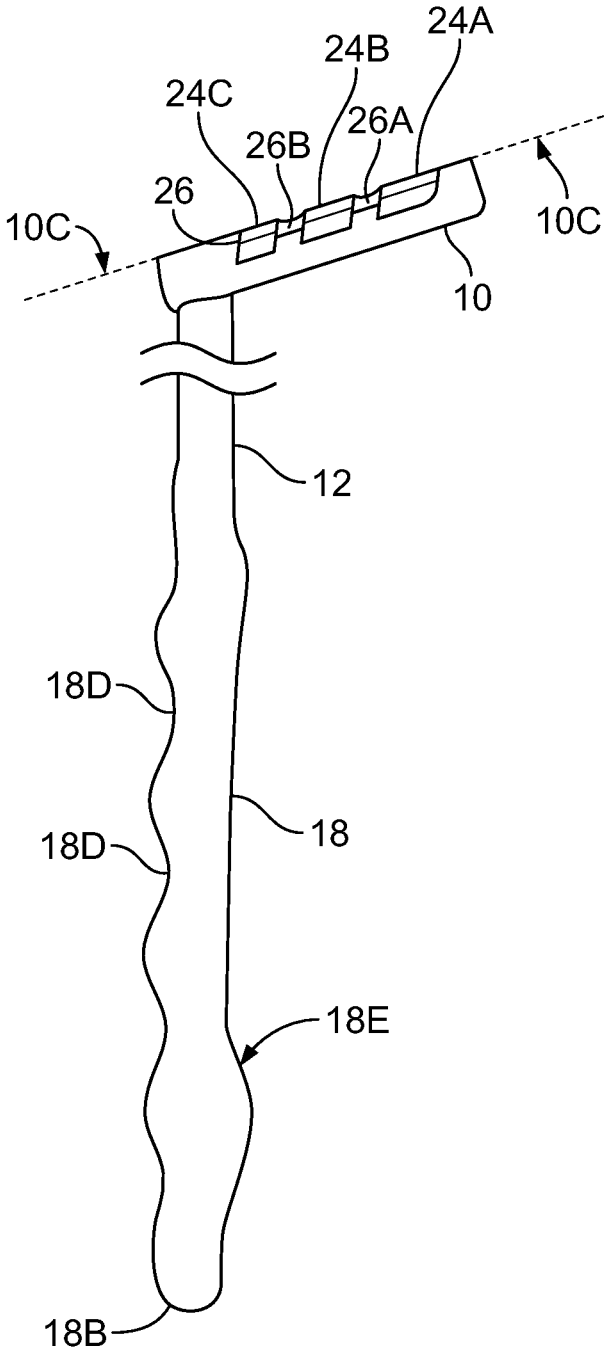
FIG. 4 is an elevational view of the side of the extender of FIG. 1.

Taking the example of FIG. 1, handle 18 of extension arm 12 is shown grasped with the right hand H, with the fingers F curled around the grip and lying in grooves 18D (FIG. 4). Thumb T can be placed against rest 22 (FIG. 2). With forearm A reaching behind, person P can manipulate extension arm 12, cradle 10, and razor 14. Specifically, razor head 14B is shown applied to the lower back and can be stroked upwardly to shave hair growing there. The upper portion of the back can be shaved by lifting the hand or by grasping extension arm 12 along its midsection.

In some cases a user may wish to shave another body part, such as a leg. In that case, extension arm 12 can be deployed so that shaver head 14B rides along the shin, calf or other leg surfaces.

It will be appreciated that the foregoing extender is highly useful when the area to be shaved is not easily accessed either because of a user's normal but limited flexibility or because a user may have a handicap or infirmity.

To remove razor 14 or razor 114, the user may outwardly push lash 16 near the outer corner of projection 24A. It will be noticed that this outside corner has a bevel 24A1 which facilitates dislodging of the lash 16. Once it clears projection 24A, lash 16 becomes slack and is easily removed.

Figure 7:
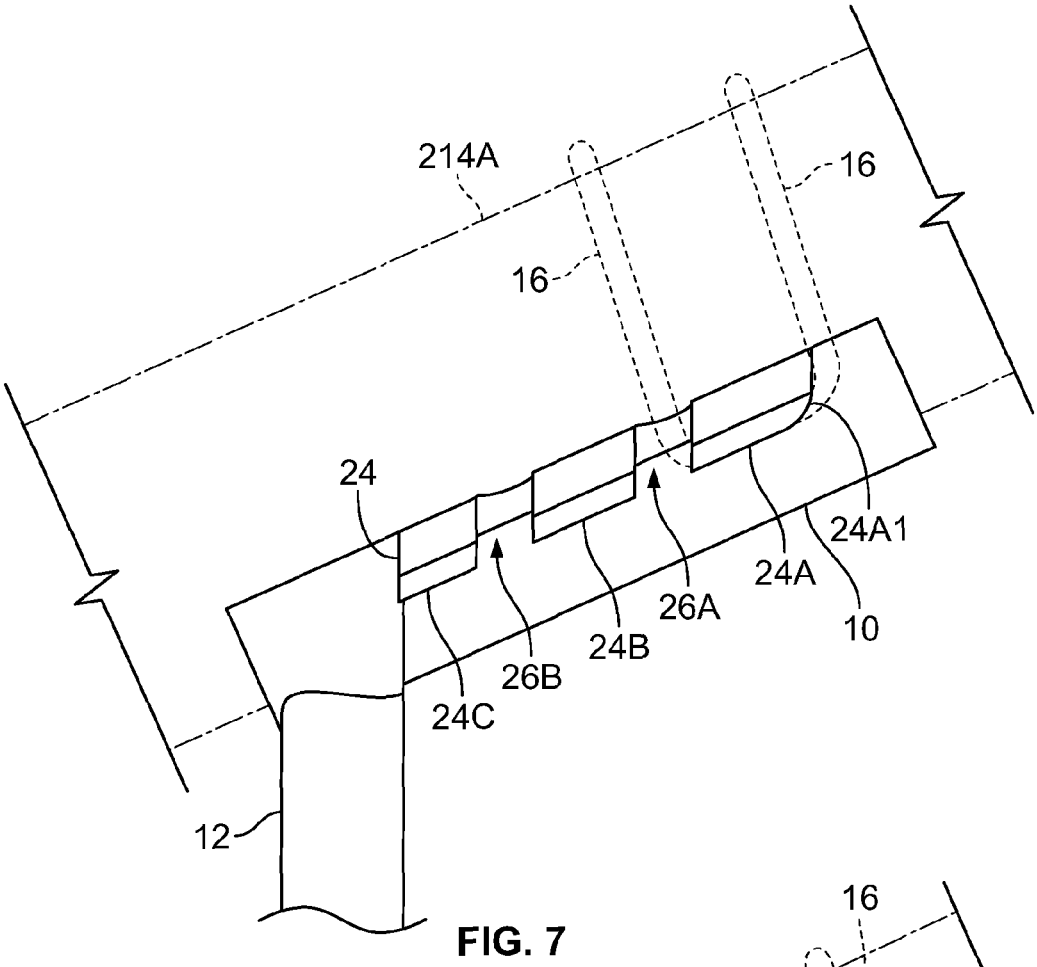
FIG. 7 is a side elevational view of the extender of FIG. 5 with its lash shown in phantom and routed differently from that shown in FIG. 6.

Referring to FIG. 7, lash 16 (shown in phantom) has been rerouted to increase its capacity in order to hold relatively larger razor handle 214A (also shown in phantom). Unlike FIGS. 5 and 6, lash 16 is routed as follows: through notch 26A, under projection 24A, emerging upwardly to arch over the top of handle 214A, and then under projection 28A (FIG. 5), before emerging through notch 30A and arching back over handle 214A to return to the point and place of beginning. As before, lash 16 can be removed by pressing it outwardly over the bevelled corner 24A1.

Figure 8:
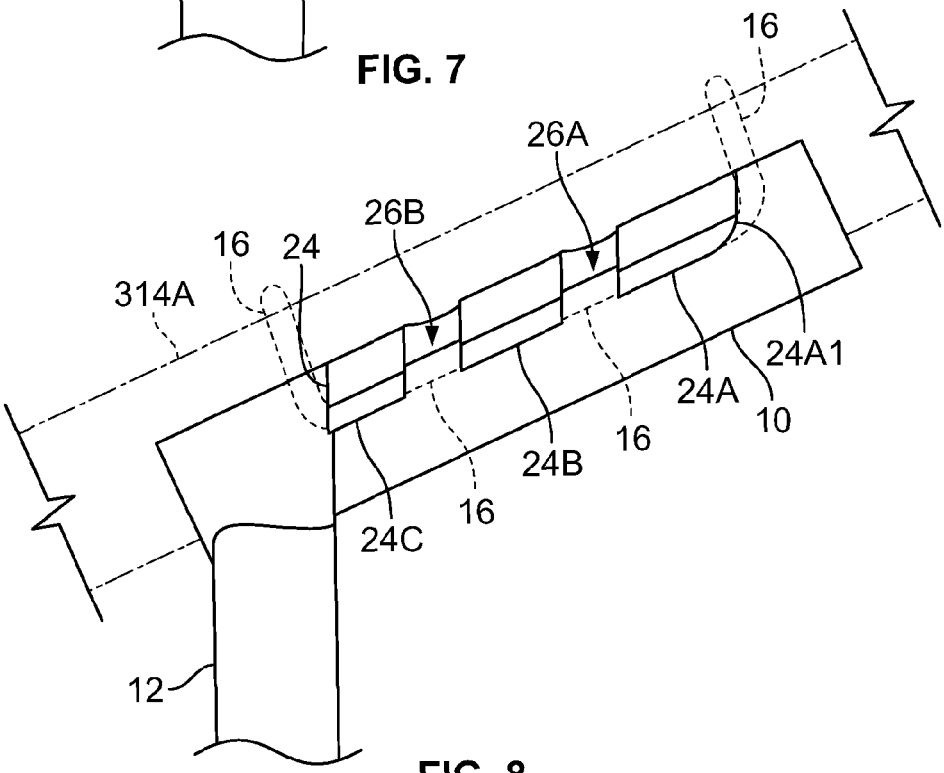
FIG. 8 is a side elevational view of the extender of FIG. 5 with its lash shown in phantom and routed differently from that shown in FIGS. 6 and 7.
Figure 9:
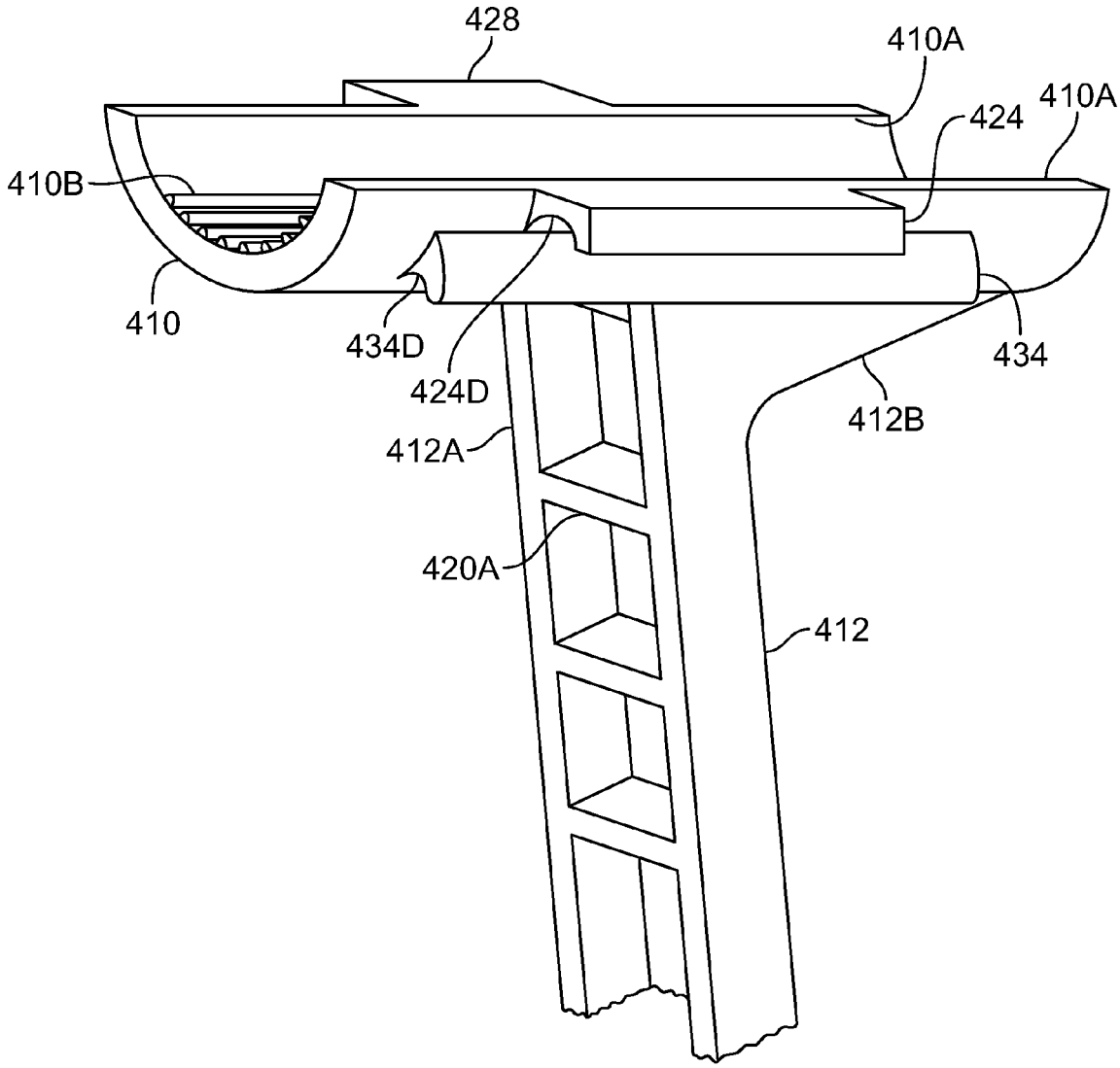
FIG. 9 is a fragmentary, perspective view of the distal end of an extender that is an alternate to that shown in FIG. 1.

Referring to FIG. 8, lash 16 (shown in phantom) has been rerouted to decrease its capacity in order to hold relatively small razor handle 314A (also shown in phantom). Specifically, lash 16 is routed as follows: under projections 24C, 24B, and 24A, in that order, emerging upwardly to arch over the top of handle 314A, and then under projections 28A, 28B, and 28C (FIG. 5), in that order, before emerging and arching back over handle 314A to return to the point and place of beginning. As before, lash 16 can be removed by pressing it outwardly over the bevelled corner 24A1.

It will be noticed from FIGS. 5-8 that the capacity of lash 16 is altered by selecting various ones of the notches 24A, 24B, 30A and 30B, or by selecting no notches (the example of FIG. 8). In the foregoing examples lash 16 crossed over the razor handle without changing its longitudinal position. In some cases however, lash 16 may change longitudinal position; for example, arching over the razor handle by traveling from notch 26B to notch 30A.

Referring to FIGS. 9 and 10A-10D, an alternate extender is shown with a cradle 410 attached to the distal end of extension arm 412. Components corresponding to those shown in FIGS. 1-9 have the same reference numerals but increased by 400. The axis of extension arm 412 obliquely intersects cradle 410 closer to its center, and has reinforcing gusset 412B for added stability. The inside of cradle 410 has eight longitudinal ridges 410B for avoiding axial rotation of a razor handle.

In this embodiment, the outwardly extending members include outwardly extending ledges 424 and 428, projecting from opposite edges 410A. The ledges 424 and 428 have a concave underside 424D and 428D, respectively, and are otherwise flat on the top and on the outside. The ledges 434 and 436 have a concave underside 434D and 436D, respectively, and a convex outside surface. Ledges 424 and 428 are roughly diametrically opposite and extend from edges 410A. Ledges 434 and 436 are immediately below a ledges 424 and 428. Thus, ledges 424 and 434 are considered a tiered plurality of outwardly extending ledges, as are ledges 428 and 436.

Figure 10A:
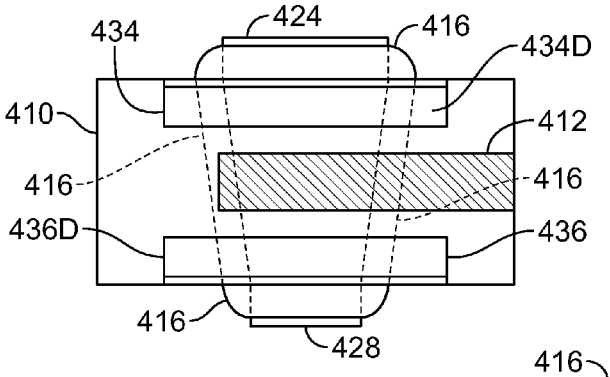
FIGS. 10A, 10B, 10C and 10D are bottom views of the cradle of FIG. 9, showing four different routings of the lash resulting in four different capacities.

It will be noticed that ledges 434 and 436 are the same length and are longer than ledges 424 and 428. Also, ledge 424 is longer than ledge 428. In FIG. 10A lash 416 is an elastomeric loop that is routed under ledges 424 and 428 and stretches over cradle 410 to capture a razor handle therein (handle not shown). In the configuration of FIG. 10A lash 416 has the greatest capacity (can be accommodate the largest razor handle), because the lash is routed under the smallest ledges (ledges 424 and 428), which are also closest to edges 410A.

Figure 10B:
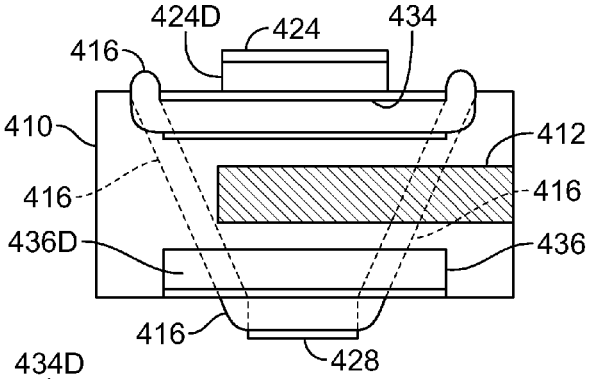

In the configuration of FIG. 10B, ledge 424 is no longer used and lash 416 is routed instead under ledge 434. Lash 416 will now have less capacity because ledge 434 is longer and further from edge 410A.

Figure 10C:
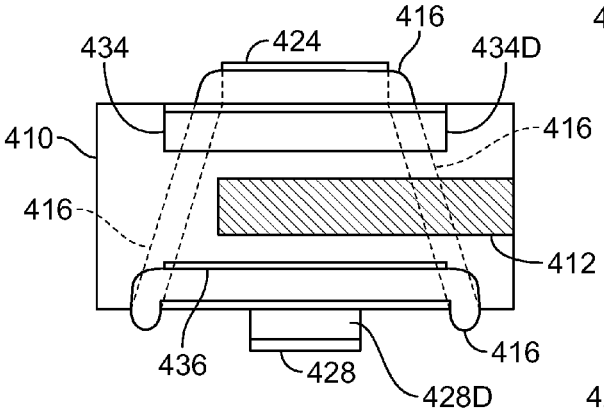

The lash routing of FIG. 10C, differs from that of FIG. 10B in that ledge 434 is replaced with ledge 424, while ledge 428 is replaced with ledge 436. While the relatively long and remote ledge 434 was retired, the new routing over ledge 436 effectively employs a new ledge with the same length and remoteness, and therefore by itself, introduces no net change in lash capacity. In contrast, the retirement of ledge 428 in favor of ledge 424, is effectively marshaling a longer ledge (ledge 424) and therefore reducing the capacity of lash 416 (relative to the configuration of FIG. 10B).

Figure 10D:
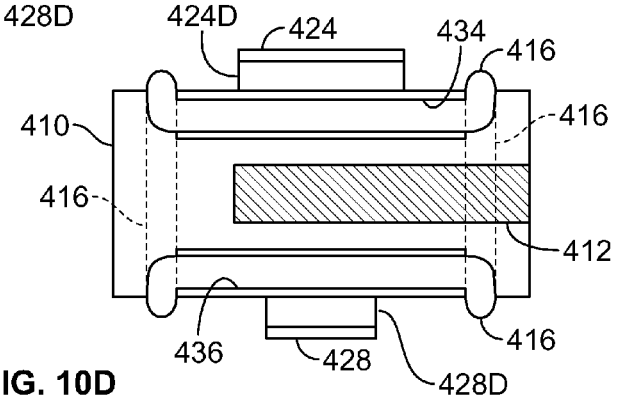

In the configuration of FIG. 10D, lash 416 is routed under the two longest and most remote ledges, namely, ledges 434 and 436. Therefore lash 416 will have the least capacity of any of the configurations of FIGS. 10A-10D.

Regardless of the specific razor secured in cradle 410 and the lash routing method (any one of the examples of FIG. 10A-10D), the shaving razor can be used as shown in FIG. 1 to shave a remote skin area.

Referring to FIGS. 11 and 12A-12C, an alternate extender is shown with a cradle 510 attached to the distal end of extension arm 512. Components corresponding to those shown in FIGS. 1-9 have the same reference numerals but increased by 500. The axis of extension arm 512 obliquely intersects cradle 510 closer to its center.

Figure 11:
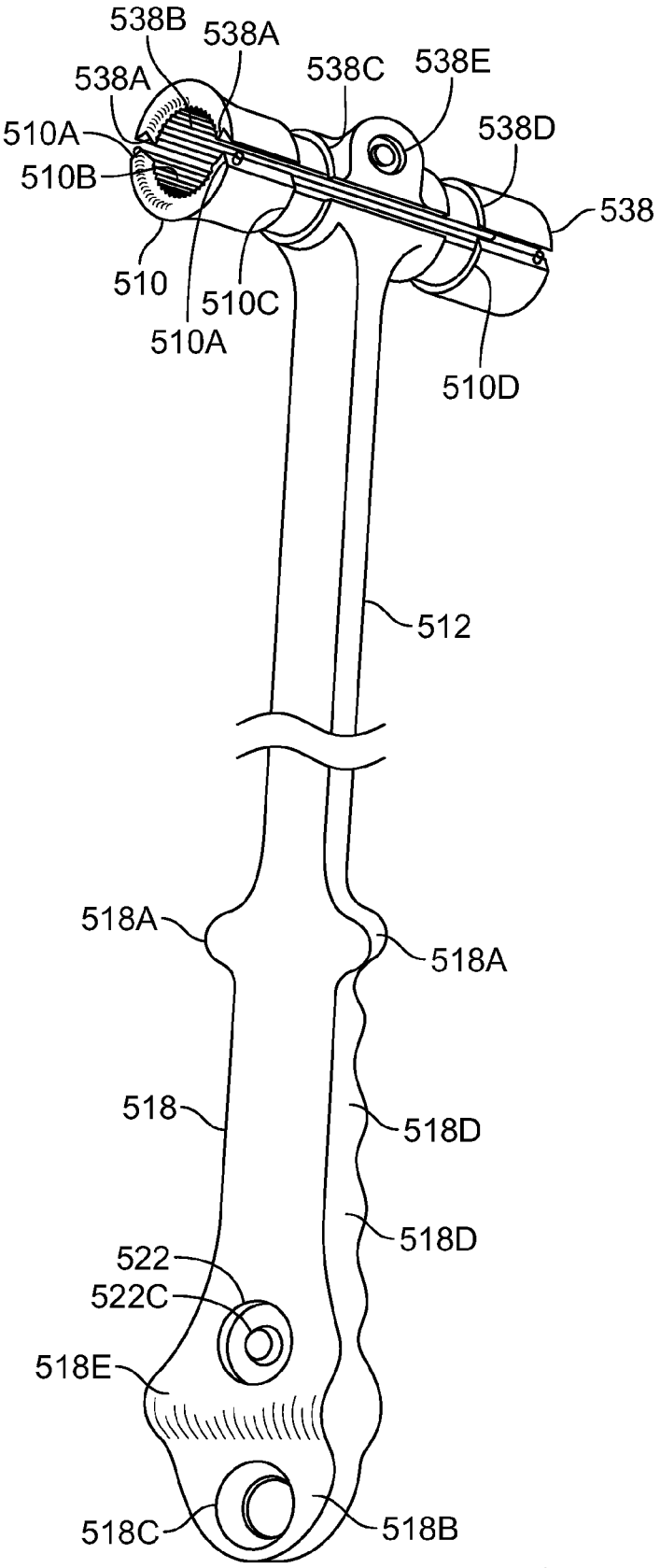
FIG. 11 is a perspective view of an extender that is an alternate to that shown in FIGS. 1 and 9.

In this embodiment, handle 512 and grip 518 are solid and their front faces are shown in FIG. 11 as essentially flat except for hang hole 518C, hump 518E and thumb rest 522, which is a cylindrical depression containing a concentric cylindrical stub 522C.

The inside of cradle 510 has longitudinal ridges 510B for avoiding axial rotation of a razor handle. The edges 510A of cradle 510 are pointed and form a triangular prism that mates with triangular trough 538A of cowl 538. Cowl 538 has a roughly semicylindrical shape with longitudinals ribs 538B on the inside. A finger grip 538E is shown on one side of cowl 538, and it will be understood that an identical finger grip (not shown) is located on the other side of the cowl. Grip 538E is shown as a cylindrical depression containing a concentric cylindrical stub.

Cowl 538 has circumferential channels 538C and 538D that align with circumferential channels 510C and 510D, respectively, of cradle 510. As described further hereinafter, elastomeric lashes can be installed in these channels to secure cowl 538 and cradle 510 together. For reasons to be described presently, these elastomeric lashes have a relatively greater ability to stretch to accommodate a wide range of razor handles of varying sizes.

Figure 12A:
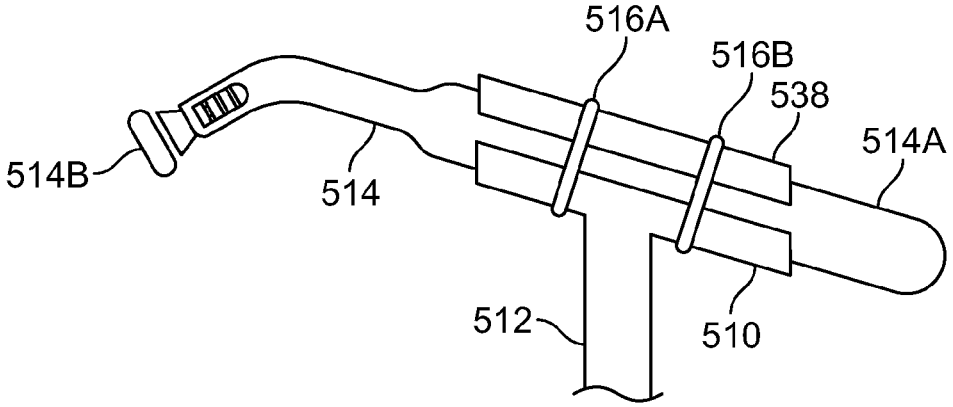
FIGS. 12A, 12B, and 12C are fragmentary, side elevational views of the extender of FIG. 11 holding different size razor handles, with FIG. 12C showing the largest handle being held without the cowl shown in the other two Figures.

Referring to FIGS. 11 and 12A, cowl 538 is positioned over cradle 510. Elastomeric lash 516A is placed in channels 510C and 538C and elastomeric lash 516B is placed in channels 510D and 538D to squeeze cowl 538 and cradle 510 together. Cowl 538 can be manually seized at finger grips 538E to separate cowl 538 from cradle 510 in order to slip between them handle 514A of shaving razor 514. Lashes 516A and 516B then clamp handle 514A between cradle 510 and cowl 538. Ridges 510B of cradle 510 and ribs 538B of cowl 538 engage handle 514A to prevent axial rotation thereof.

Figure 12B:
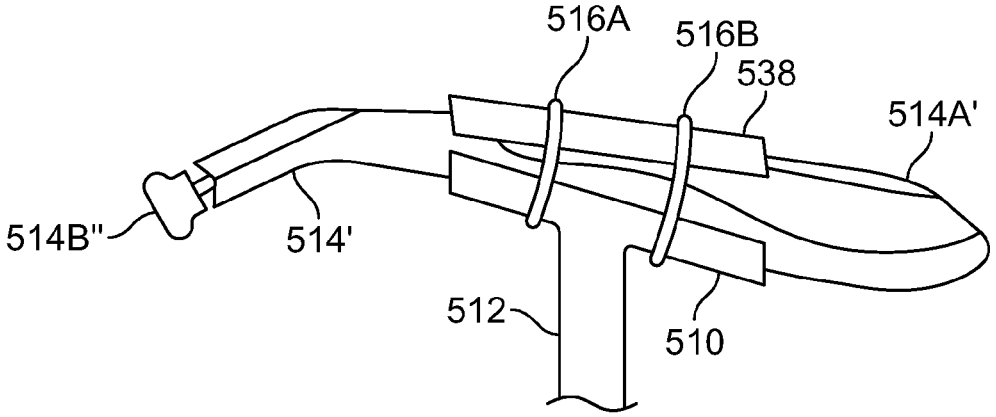

Referring to FIGS. 11 and 12B, cowl 538 can be manually seized at finger grips 538E to separate cowl 538 from cradle 510 in order to slip between them handle 514A' of shaving razor 514'. As before, lashes 516A and 516B clamp handle 514A' between cradle 510 and cowl 538. Ridges 510B and ribs 538B of cowl 538 engage handle 514A also as before. It will be noticed that cowl 538 is being held at a diverging angle relative to cradle 510 in order to increase capacity and accommodate the bulbous proximal end of handle 514A'. Also, lashes 516A and 516B are able to stretch sufficiently to accommodate this specific orientation.

Figure 12C:
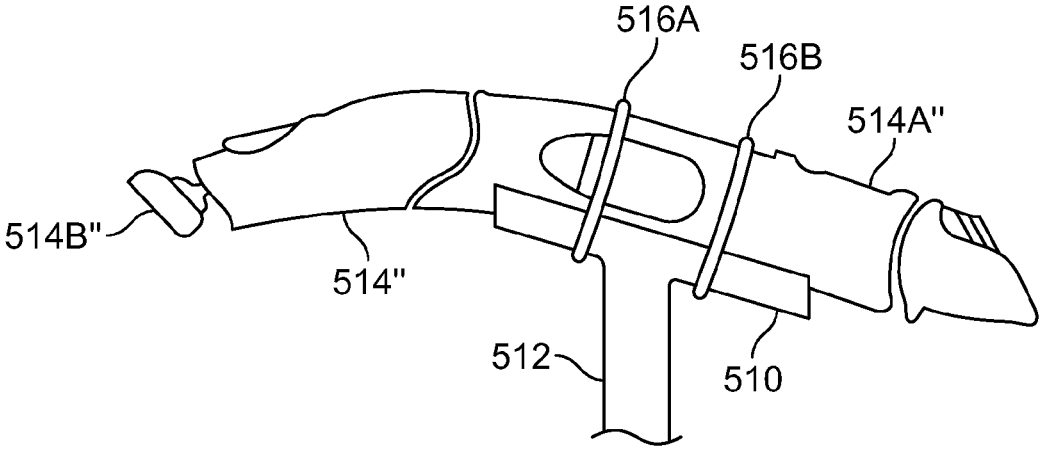

Referring to FIGS. 11 and 12C, previously mentioned cowl 538 has been removed to increase capacity and accommodate relatively large razor handle 514A". In this case lashes 516A and 516B directly contact handle 514A" to secure it in cradle 510.

Again, lashes 516A and 516B are able to stretch sufficiently to accommodate this specific arrangement.

Regardless of the specific razor secured in cradle 510 and the orientation (or elimination) of cowl 538, the shaving razors of FIGS. 12A-12C can be used as shown in FIG. 1 to shave a remote skin area.

It is appreciated that various modifications may be implemented with respect to the above described embodiments. While a generally straight extension arm is disclosed, in some embodiments the arm can be curved, have compound curves, or have a plurality of angularly disposed straight sections. In some embodiments the cradle can be flexible, can fold, or can be hinged to allow the cradle to squeeze the razor handle. In some embodiments the outwardly extending members can be pegs with a variety of cross-sections, button-like projections, or stubs that flare outwardly or curve in any one of a variety of directions. In some embodiments the lash can be a cord with one or two ends secured to one side of the cradle and designed to be draped over a razor handle before snapping onto a fixture on the opposite side of the cradle. In some embodiments the lash can be tightened around the razor handle by being pulled and wedged into a converging slot on one side of the cradle. In addition, the cradle and extension arm can be made from a variety of materials, including plastics, metal, wood, composite materials, etc. Furthermore, the size and dimensions of the cradle and extension arm can be varied depending upon the desired length of extension, and the type of razor handle that is expected.

Obviously, many modifications and variations of the present invention are possible in light of the above teachings. It is therefore to be understood that within the scope of the appended claims, the invention may be practiced otherwise than as specifically described.

The invention claimed is:

1. An extender for holding a shaving razor by its razor handle, comprising:

an extension arm having a proximal and a distal end;

a cradle coupled to the distal end of said extension arm and sized to receive said razor handle, said cradle having a longitudinal axis and a spaced pair of longitudinally extending edges; and a lash adapted to be connected across the spaced pair of edges of said cradle for holding said razor handle in said cradle, said lash having a length and transverse thereto a width, said length being greater than said width, said cradle having a cradle length and width sized to accept said razor handle in a predetermined position that avoids rocking of said razor handle about an axis transverse to the longitudinal axis of said cradle, said cradle, absent the lash, being open and free of obstructions to allow the razor handle to move into the predetermined position in the cradle in a direction transverse to the longitudinal axis of the cradle, the cradle having an opposite pair of outwardly extending members extending in opposite directions away from said cradle and away from said longitudinal axis, one of said pair of outwardly extending members being mounted at one edge of the spaced pair of edges and the other one of said pair of outwardly extending members being mounted at the other edge of the spaced pair of edges, said opposite pair of members each providing a straight passage adapted to have a respective straight length of said lash lie in said straight passage and extend in a longitudinal direction to secure the razor handle in place, said opposite pair of outwardly extending members comprising a parallel pair of curled lips each having a concave underside and each terminating in a distal edge that extends longitudinally.

2. An extender according to claim 1 wherein said spaced pair of edges have an edge to edge spacing less than said cradle length.

3. An extender according to claim 1 wherein said spaced pair of edges have an edge to edge spacing less than half said cradle length, the cradle having a pair of opposite ends that are open to allow the razor handle to extend along the longitudinal axis beyond the pair of opposite ends.

4. An extender according to claim 1 wherein said lash is elastomeric.

5. An extender according to claim 1 wherein said opposing pair of outwardly extending members extend in opposing directions.

6. An extender according to claim 5 wherein at least one of said pair of outwardly extending members has a spaced plurality of projections providing at least one gap, said lash being routed under said at least one of said pair of outwardly extending members and through said at least one gap.

7. An extender according to claim 1 wherein said lash is an elastomeric loop adapted to be routed under the curled lip of each of said spaced edges.

8. An extender according to claim 7 wherein the curled lip of each of said spaced pair of edges has at least one notch, said lash being adapted to be routed under the curled lip of each of said spaced pair of edges and through said at least one notch of the curled lip of each of said pair of spaced edges, the curled lip having a length stretching along the longitudinal axis and being uninterrupted over most of its length by the at least one notch.

9. An extender according to claim 7 wherein the curled lip of each of said spaced pair of edges has a pair of notches, said lash being adapted to be routed under the curled lip of each of said spaced pair of edges and through a selected one of said pair of notches of the curled lip of each of said pair of spaced edges, the pair of notches of the curled lip of each of the pair of edges being selectable to allow a change in capacity of said lash around said razor handle.

10. An extender according to claim 7 wherein said cradle has a plurality of longitudinal ridges for engaging the razor handle, each of said plurality of ridges having a peak engaging the razor handle.

11. An extender according to claim 1 wherein one of said spaced pair of edges has a circumferentially spaced, tiered plurality of outwardly extending ledges, said tiered plurality of ledges each having a length extending longitudinally, said lash being adapted to be routed under a selected one of said tiered plurality of ledges, said tiered plurality of ledges being selectable to allow a change in capacity of said lash around said razor handle.

12. An extender according to claim 11 wherein said tiered plurality of ledges have different lengths as measured in a direction parallel to the longitudinal axis.

13. An extender according to claim 1 wherein said spaced pair of edges each have a tiered plurality of outwardly extending ledges, said lash being adapted to be routed under a selected one of said tiered plurality of ledges at each of said spaced pair of edges, said tiered plurality of ledges on each of said spaced pair of edges being selectable to allow a change in capacity of said lash around said razor handle.

14. An extender according to claim 13 wherein some of said plurality of ledges on the spaced pair of edges have differing lengths.

15. An extender according to claim 14 wherein each of said plurality of ledges on the spaced pair of edges has a concave underside for receiving at least a portion of said lash.

16. An extender according to claim 1 comprising:

a cowl having opposite ends and opposite edges and being sized to fit over a side of the razor handle that is opposite said cradle, said lash being adapted to be routed around said cowl and said cradle to hold between them said razor handle, other than through the lash, the cowl being unconnected to the cradle and extension arm, the opposite ends and the opposite edges of the cowl being free to move away from the cradle in any direction.

17. An extender according to claim 16 wherein said lash is elastomeric, said cowl having longitudinal ribs for engaging the razor handle, said cradle having longitudinal ridges for engaging the razor handle, each of said plurality of ridges having a peak engaging the razor handle.

18. An extender according to claim 1 wherein said longitudinal axis of said cradle extends obliquely from said extension arm.

19. An extender according to claim 1 wherein at least one of said spaced pair of edges has an outwardly extending member, said lash being adapted to be routed under said member, said member having a beveled corner for facilitating removal of said lash from said member.

20. A method for holding a shaving razor and employing a cradle on an extension arm and a lash, wherein said lash has a length and transverse thereto a width, said length being greater than said width, and wherein the cradle has on one of its edges a tiered plurality of outwardly extending ledges, the method comprising the steps of:

moving the razor handle into the cradle in a direction transverse to the handle; and terminating the lash on the cradle on opposite sides of the razor handle to avoid rocking of said razor handle about an axis transverse to the longitudinal axis of said cradle, the step of terminating the lash being performed by laying a straight length of said lash under a selected one of said tiered plurality of ledges, the straight length having a length extending longitudinally in a direction parallel to the razor handle, said tiered plurality of ledges being selectable to allow a change in capacity of said lash around said razor handle.

* * * * *